US006491284B1

(12) United States Patent
Jolly et al.

(10) Patent No.: US 6,491,284 B1
(45) Date of Patent: Dec. 10, 2002

(54) CARPET STRETCHING DEVICE

(76) Inventors: Richard A. Jolly, 3606 NE. 104$^{th}$ St., Vancouver, WA (US) 98686; Kenneth Jolly, 4735 NE. 103rd Ave., Portland, OR (US) 97220; Brian Jolly, 3606 NE. 104$^{th}$ St., Vancouver, WA (US) 98686

( * ) Notice: Subject to any disclaimer, the term of this patent is extended or adjusted under 35 U.S.C. 154(b) by 0 days.

(21) Appl. No.: 09/594,353

(22) Filed: Jun. 14, 2000

Related U.S. Application Data

(60) Provisional application No. 60/139,150, filed on Jun. 14, 2000.

(51) Int. Cl.$^{7}$ ..... B65H 77/00

(52) U.S. Cl. ..... 254/209

(58) Field of Search ..... 254/200, 201, 254/206, 207, 209, 210, 212; 294/8.6

(56) References Cited

U.S. PATENT DOCUMENTS

| | | | | |
|---|---|---|---|---|
| 96,700 | A | | 11/1869 | Howard |
| 300,396 | A | | 6/1884 | Poindexter |
| 317,296 | A | | 5/1885 | Carter |
| 452,508 | A | | 5/1891 | Rice |
| 695,672 | A | | 2/1902 | Diaz |
| 870,671 | A | | 11/1907 | Freed |
| 876,817 | A | | 1/1908 | Logan |
| 910,595 | A | * | 1/1909 | Smith ..... 254/209 |
| 943,199 | A | | 12/1909 | Noll |
| 965,118 | A | * | 7/1910 | McBeth ..... 254/209 |
| 1,033,552 | A | | 7/1912 | Dehlinger |
| 1,072,599 | A | | 9/1913 | Gibbons |
| 1,258,481 | A | | 3/1918 | Shobar |
| 1,579,002 | A | | 3/1926 | Koch |
| 2,221,325 | A | | 11/1940 | Holman |
| 2,415,303 | A | | 1/1947 | Moore |
| 3,001,762 | A | | 9/1961 | Skolnick |
| 3,166,757 | A | | 1/1965 | Downs |
| 3,178,155 | A | | 4/1965 | Bird |
| 3,207,474 | A | | 9/1965 | Silva |
| D206,615 | S | | 1/1967 | Brenner |
| 3,311,347 | A | | 3/1967 | Thompson |
| 3,322,209 | A | | 5/1967 | Cavanaugh |
| D209,620 | S | | 12/1967 | Kochanowski |
| 3,374,023 | A | | 3/1968 | Hill et al. |
| 3,693,936 | A | | 9/1972 | Payson |
| 3,752,440 | A | | 8/1973 | Ream |
| 3,980,274 | A | | 9/1976 | Ebert |
| 4,509,725 | A | * | 4/1985 | Talavera ..... 254/212 |
| 5,150,884 | A | | 9/1992 | Hyer et al. |
| 5,183,238 | A | | 2/1993 | Sorensen |

FOREIGN PATENT DOCUMENTS

| | | |
|---|---|---|
| CA | 450351 | 8/1948 |

* cited by examiner

*Primary Examiner*—Emmanuel Marcelo
(74) *Attorney, Agent, or Firm*—Kolisch Hartwell, P.C.

(57) ABSTRACT

A carpet stretching device and method of using the same to install carpet on stairs, the device including a primary support arm extending from an anchor to a base, a lever arm extending from a grip to a base, a gripping head having carpet-engaging teeth attached to a base, and a stretching mechanism operatively connecting the base of the support arm to the base of the gripping head. The stretching mechanism also is operatively connected to the lever arm, so that application of a force to the grip of the lever arm forces the gripping head to move toward the anchor of the primary support arm.

1 Claim, 3 Drawing Sheets

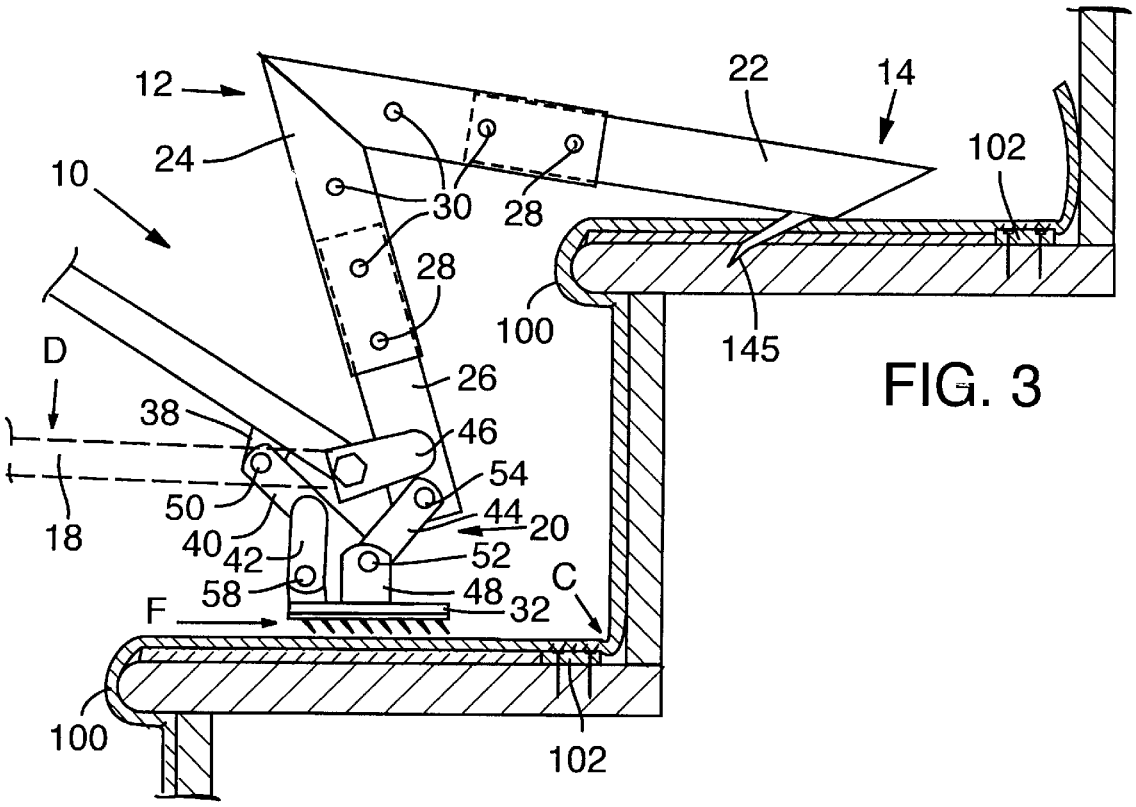
FIG. 3
FIG. 4
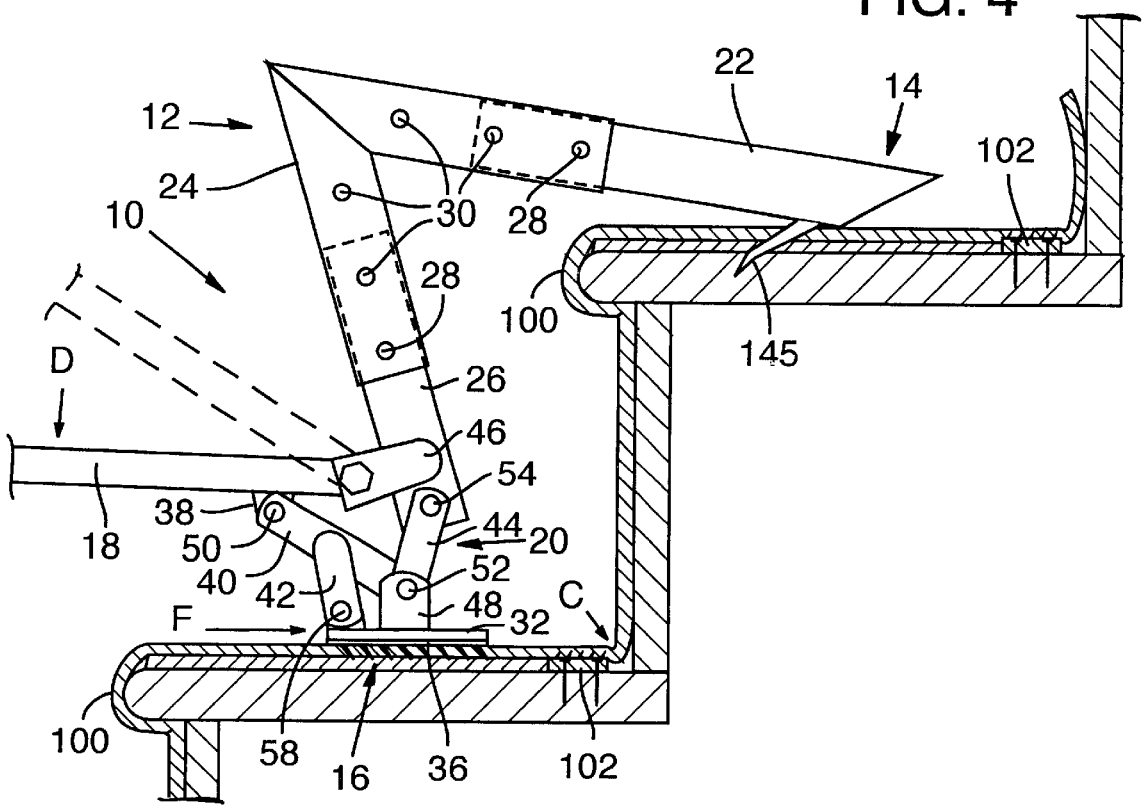

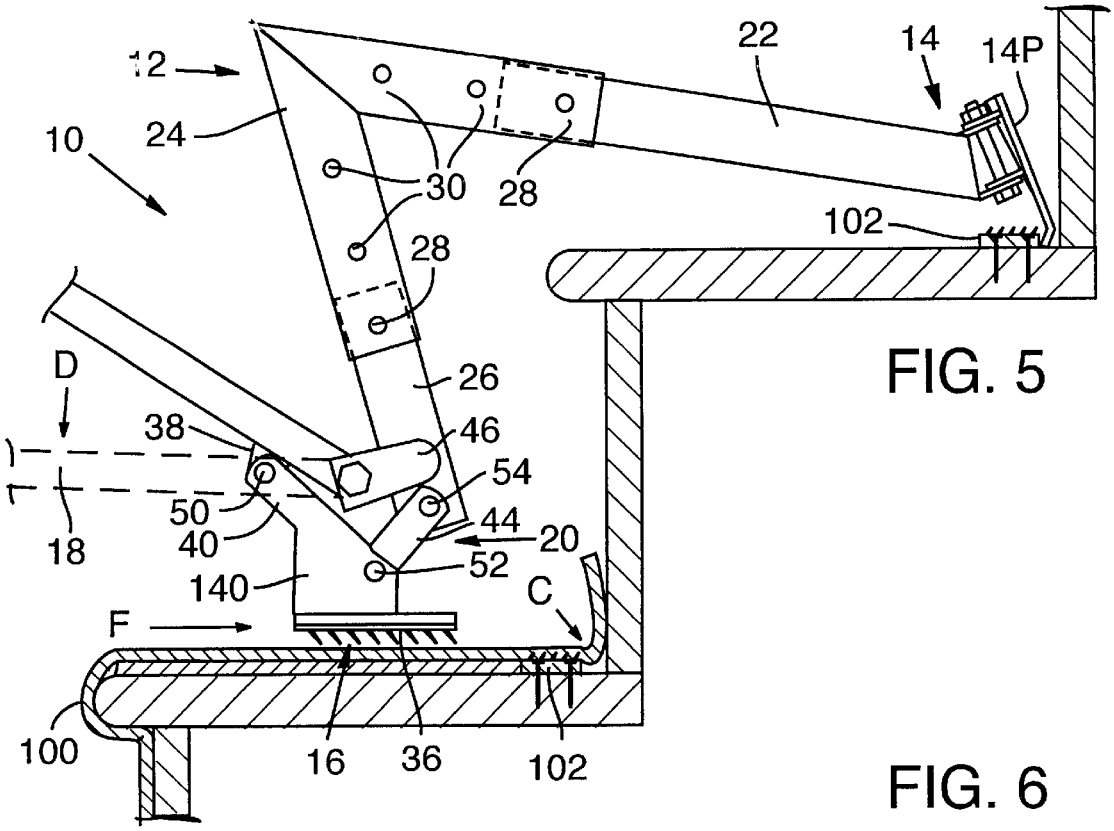
FIG. 5
FIG. 6
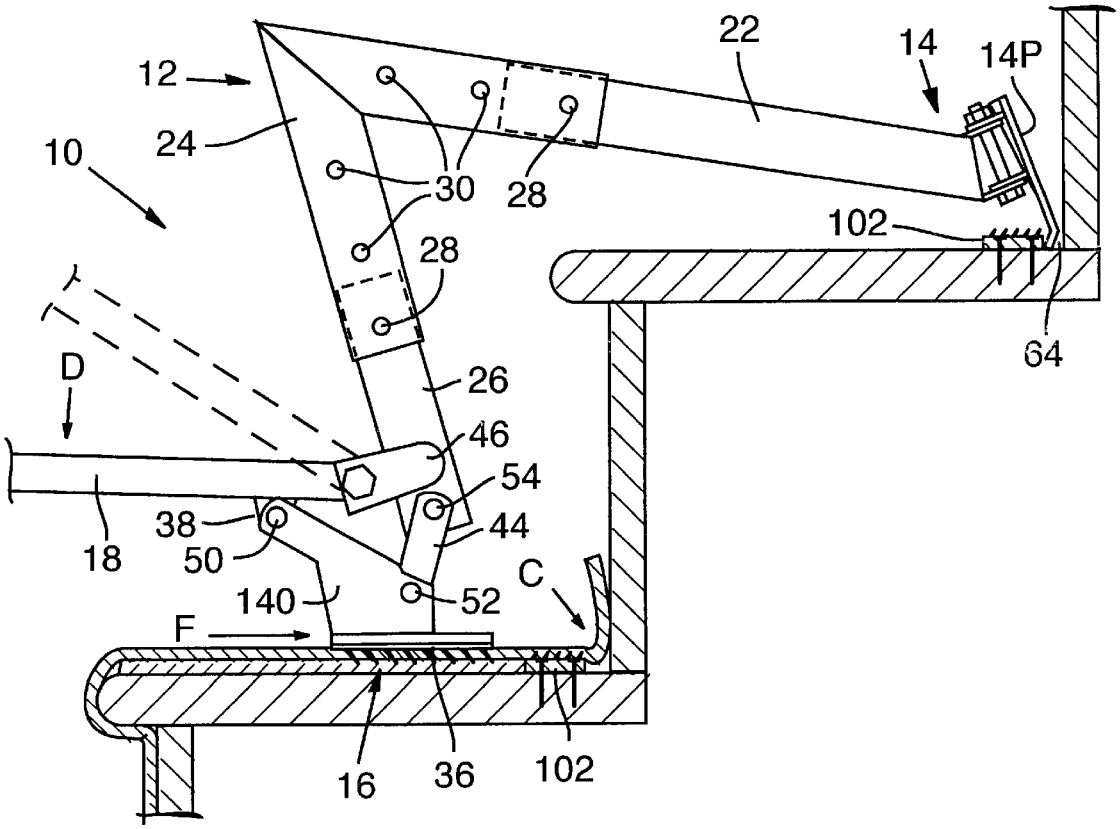

CARPET STRETCHING DEVICE

CROSS-REFERENCE TO RELATED APPLICATIONS

This application claims priority from U.S. provisional patent application Ser. No. 60/139,150, entitled "Carpet Stretching Device," filed on Jun. 14, 2000, the disclosures of which are incorporated herein.

BACKGROUND AND SUMMARY OF THE INVENTION

The present invention relates generally to carpet stretching tools, and more specifically to a portable carpet stretching device for stretching carpeting over stairs during the installation process. In particular, the preferred embodiment of the stretching mechanism of the present invention includes a structural combination of links and pivoting joints, connecting to a primary support arm, a lever arm and an anchor.

Carpet stretching tools with various stretching mechanisms are shown in U.S. Pat. Nos. Des. 206,615, 209,620, 96,700, 213,402, 300,396, 317,296, 452,508, 695,672, 870, 671, 876,817, 943,199, 1,033,552, 1,072,599, 1,258,481, 1,579,002, 2,221,325, 2,415,303, 3,001,762, 3,166,757, 3,178,155, 3,207,474, 3,311,347, 3,322,209, 3,685,064, 3,693,936, 3,374,023, 3,752,440, 3,980,274, 4,003,549, 4,230,302, 5,150,884, 5,183,238, 5,782,458, incorporated herein by reference. Additionally, a stretching mechanism is shown in a Canadian Patent No. 450,351, also incorporated herein by reference. However, none of the prior carpet stretching tools include a stretching mechanism and a primary support arm having a fixed angle between portions of the arm, as found in the present invention.

The carpet stretching device of the present invention typically is used to install carpet over a flight of stairs from the bottom to the top. The primary support arm includes an anchor, such as a spike or a plate, that provides a secure attachment of the device to an upper step of the stairs, allowing the lever arm, the stretching mechanism and the barbed foot to be operated properly on a lower step. A downward push on the lever arm forces the foot toward the anchor through a pivoting action of the stretching mechanism. The movement of the foot then stretches the carpet toward a tack board on the step, where the carpet is held by the tack board.

The carpet stretching device of the present invention is easy to use, effective, and safe. It also eliminates knee injuries caused by using the traditional knee kicker for installing carpet over stairs. Other advantages of the present invention will be understood more readily after a consideration of the drawings, photos and the Detailed Description of the Preferred Embodiment

BRIEF DESCRIPTION OF THE DRAWINGS AND PHOTOS

FIG. 3 is a side view of the device shown in FIG. 1, shown in an initial position in solid lines, with its lever arm moved to a stretching position in dashed lines.

FIG. 4 is a side view of the device shown in FIG. 3, shown in the stretching position of FIG. 3, in solid lines, with its lever arm moved back to a release position in dashed lines.

FIG. 5 is a side view of the device shown in FIG. 2, with an alternative stretching mechanism, shown in an initial position in solid lines, with its lever arm moved to a stretching position in dashed lines.

FIG. 6 is a side view of the device shown in FIG. 4, shown in the stretching position of FIG. 5, in solid lines, with its lever arm moved back to a release position in dashed lines.

DETAILED DESCRIPTION

Figure 1:
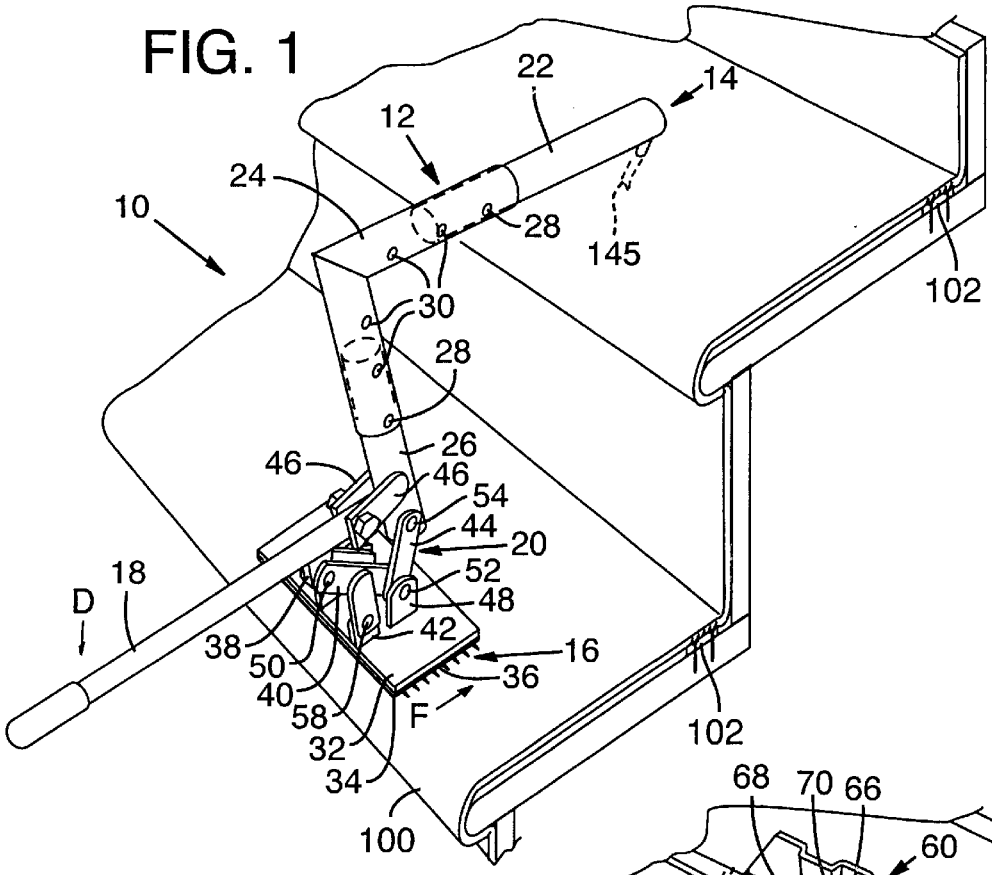
FIG. 1 is an isometric view of the carpet stretching device according to the present invention, shown placed on a carpeted step, and with an anchor in the form of a barb that pierces carpet on the step to grip the underlying tread.

A carpet stretching device 10 is shown in FIG. 1, to include a primary support arm 12, at one end of which is an anchor 14, and at the other end of which is a barbed foot 16. A movable lever arm 18 is interconnected between primary support arm 12 and foot 16 by a stretching mechanism 20, so that a downward movement of lever arm 18 causes foot 16 to move toward anchor 14. In operation, movement of lever arm 18, as shown in FIG. 1 by arrow D, pulls a section of carpet 100 toward anchor 14, as shown by arrow F, thereby stretching the carpet over a tack board 102.

Primary support arm 12 preferably is tubular and includes three separable segments as shown in FIG. 1: a forearm segment 22, an elbow segment 24 with an angle, and a base arm segment 26 connecting to stretching mechanism 20 and lever arm 18. Segments 22 and 26 include spring-loaded pins 28 that fit into holes 30 on segment 24. This results in an adjustable assembly that allows carpet stretching device 10 to be used on steps of a stairs having varying tread depth and rise.

Anchor 14 may take several forms, two of which are shown in the drawings. One form is a sharp-tipped spike 14s shown in FIGS. 1, 3 and 4. It can be driven into the surface of a tread above the work area, providing a secure attachment and preventing the entire device from moving during its use. Another form of anchor 14 is a plate **14*p* shown in FIGS. 2, 5 and 6. Plate 14*p* is placed behind a tack board 102, allowing a pulling force to be exerted on the step without the need for piercing the upper surface of the step with any part of tool 10**.

Foot 16 includes a steel plate 32 with a conventional cotton-head carpet gripper 34, including a plurality of teeth 36. Foot 16 grabs carpet 100 through teeth 36. Several types of teeth 36 may be used on a single foot 16, and retractable or adjustable teeth may be used, if desired. These teeth 36, and retracting mechanisms containing such teeth 36, are available from various manufacturers, including Taylor and Roberts.

Lever arm 18 drives stretching mechanism 20 and subsequently foot 16 through a fixed link 38, a movable link 40 and a fixed link 42. Movable link 40 extends between lever arm 18 and foot 16 and exerts a forward force on foot 16 as arm 18 is lowered. A second movable link 44 connects primary support arm 12 to foot 16, through fixed link 48, and is under tension as lever arm 18 is pushed down.

A fixed link 46 extends outwardly from primary support arm 12 to provide a primary pivot for lever arm 18, and a similar fixed link 48 extends outwardly from foot 16 to provide a pivot for movable link 40. Joints 50, 52, 54, 56, and 58 are pivoting joints for links 38, 40, 42, 44, 46 and 48, as shown in FIG. 1. Stretching mechanism 20 includes duplicate links 38, 40, 42, 44, 46, 48 and pivoting joints 50, 52, 54, 56, 58, as shown in FIG. 1 by a second link 46 that is visible behind support arm 12.

Figure 2:
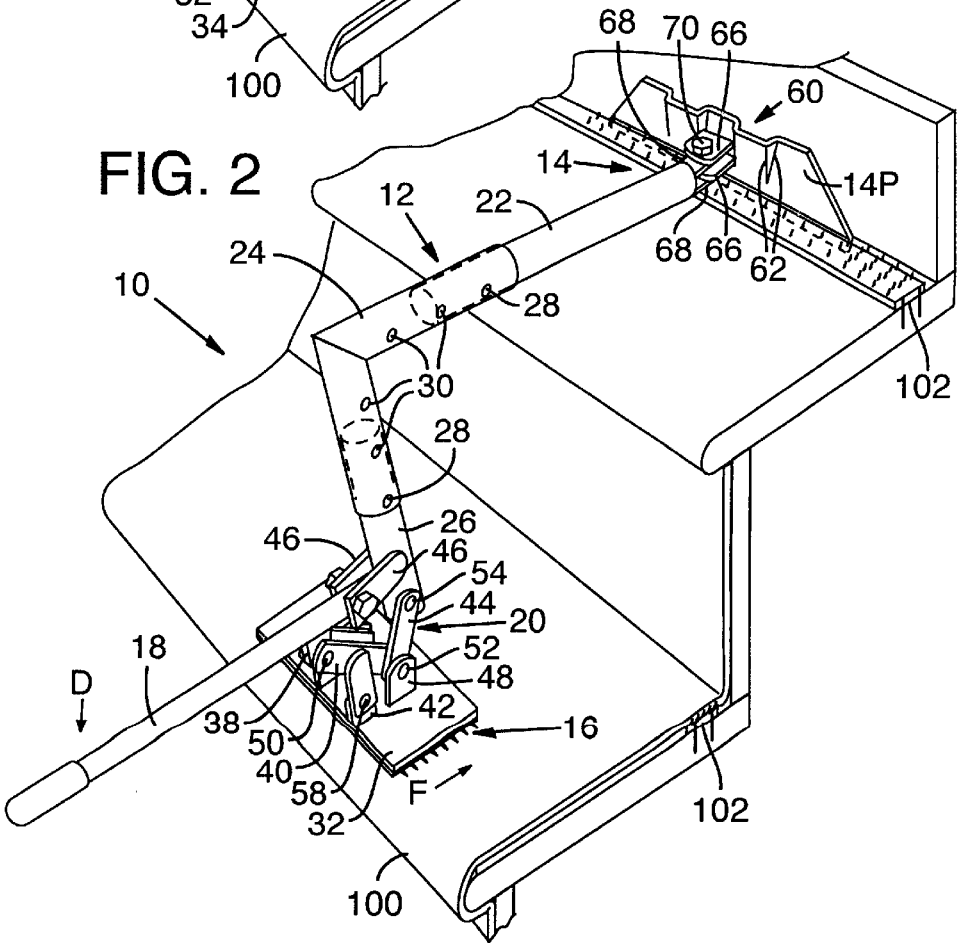
FIG. 2 is an isometric view of the device shown in FIG. 1, but with an alternative anchor that grips an exposed tack board.

Referring now to FIG. 2, anchor plate **14*p* is shown in to include strengthening ribs 60, formed by a plurality of bends 62. The lower end of plate 14***p* is bent to define a gripping toe 64. The bend that defines toe 64, seen best in FIGS. 5 and 6, also provides substantial lateral strength to plate 14*p*.

Plate 14*p* preferably is attached pivotally to support arm 12, so that a user of tool 10 may direct the desired force F at an angle to a tack board 102, if desired. A hinge joint may be formed as shown in FIG. 2 from a pair of flanges 66 that extend outwardly from plate 14*p*, similar flanges 68 that extend outwardly from support arm 12, and a nut and bolt 70, or other pintle, that extends through holes in flanges 66 and 68.

FIGS. 5 and 6 also show an alternative embodiment of stretching mechanism 20. In this embodiment, a single link 140 has replaced several of the links shown in FIGS. 1–4. It is believed that link 140 will be easier to manufacture for mass production.

In operation, an operator preferably holds carpet stretching device 10 by placing one hand on primary support arm 12, and by placing the other hand on lever arm 18. The hand holding primary support arm 12 alternatively may hold other tools during the carpet installation process. After carpet 100 is stretched as desired, it may be hooked onto the nails of tack board 102 by pushing down on carpet 100 in the back corner of the step, generally as shown by arrow C in FIGS. 3–6, as is well known in the art. A lifting force on device 10 then removes device 10 from engagement with carpet 100, as well as the step.

Although the invention has been disclosed in its preferred forms, the specific embodiments thereof as disclosed and illustrated herein are not to be considered in a limiting sense, because numerous variations are possible. The subject matter of the invention includes all novel and non-obvious combinations and subcombinations of the various elements, features, functions, and/or properties disclosed herein. No single feature, function, element or property of the disclosed embodiments is essential. The following claims define certain combinations and subcombinations of features, functions, elements, and/or properties that are regarded as novel and nonobvious. Other combinations and subcombinations may be claimed through amendment of the present claims or presentation of new claims in this or a related application. Such claims, whether they are broader, narrower, equal, or different in scope to any earlier claims, also are regarded as included within the subject matter of the invention.

We claim:

1. A carpet stretching device comprising:

a primary support arm;

an anchor operatively connected to a first end of the primary support arm;

a stretching mechanism, including at least four pivotal joints, operatively connected to a second end of the primary support arm;

a carpet gripper operatively connected to the stretching mechanism; and a lever arm operatively connected to the stretching mechanism and the primary support arm;

wherein application of force to the lever arm causes the stretching mechanism to move the carpet gripper toward the anchor, and wherein the stretching mechanism includes a first pivotal joint at the connection of the carpet gripper and a first movable link; a second pivotal joint at the connection of the first movable link and the primary support arm; a third pivotal joint at the connection of the primary support arm and the lever arm; and a forth pivotal joint at the connection of the lever arm and a link connected to the carpet gripper.

* * * * *